US007931273B2

(12) United States Patent
Mizuguchi

(10) Patent No.: US 7,931,273 B2
(45) Date of Patent: Apr. 26, 2011

(54) SHEET STACKING APPARATUS AND IMAGE FORMING APPARATUS

(75) Inventor: Kouhei Mizuguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 12/125,558

(22) Filed: May 22, 2008

(65) Prior Publication Data

US 2008/0290590 A1 Nov. 27, 2008

(30) Foreign Application Priority Data

May 24, 2007 (JP) ..... 2007-137841
May 15, 2008 (JP) ..... 2008-128238

(51) Int. Cl.
*B65H 31/04* (2006.01)

(52) U.S. Cl. ..... 271/214; 271/207; 271/213; 399/405; 347/104

(58) Field of Classification Search ..... 271/207, 271/213, 214; 399/405; 347/104
See application file for complete search history.

(56) References Cited

U.S. PATENT DOCUMENTS 5,111,252 A * 5/1992 Hamada et al. ..... 399/393
5,141,346 A * 8/1992 Nakagawa ..... 400/605
5,586,758 A * 12/1996 Kimura et al. ..... 271/303
5,884,117 A * 3/1999 Tanoue et al. ..... 399/1
6,134,418 A * 10/2000 Kato et al. ..... 399/405
6,428,000 B1 * 8/2002 Hara et al. ..... 271/223
7,243,915 B2 * 7/2007 Wong et al. ..... 271/3.14
7,748,705 B2 * 7/2010 Yamada ..... 271/209
2003/0185612 A1 * 10/2003 Sekiyama et al. ..... 399/405
2005/0196217 A1 * 9/2005 Nishimura et al. ..... 400/693
2007/0048003 A1 * 3/2007 Sugiyama ..... 399/107
2008/0067737 A1 * 3/2008 Kosuda et al. ..... 271/207
2009/0010697 A1 * 1/2009 Nishimura et al. ..... 399/405
2010/0166474 A1 * 7/2010 Suzuki ..... 399/405

FOREIGN PATENT DOCUMENTS

JP 04223964 A * 8/1992
JP 2006-188363 7/2006

* cited by examiner

*Primary Examiner* — Kaitlin S Joerger
*Assistant Examiner* — Prasad V Gokhale
(74) *Attorney, Agent, or Firm* — Fitzpatrick, Cella, Harper & Scinto

(57) ABSTRACT

A discharge tray which needs to turn as a cover of an apparatus body opens and closes can be folded. When the cover is opened, the discharge tray is folded, and a wide installation area and a wide occupying area are not required. An image forming apparatus includes the apparatus body which forms an image on a recording paper sheet, an upper cover 130 which opens and closes the apparatus body, and a discharge tray 200 on which a sheet discharged from the apparatus body is stacked. The discharge tray is divided into a sheet stacking portion 133 and trays 210, 220 and 230 in a discharge direction of the recording paper sheet, and the discharge tray is provided over the apparatus body and the cover. The trays are turnably connected such that they can be folded as the upper cover opens and they can be extended as the upper cover closes.

8 Claims, 15 Drawing Sheets

SHEET STACKING APPARATUS AND IMAGE FORMING APPARATUS

BACKGROUND OF THE INVENTION

1. Field of the Invention

The present invention relates to a sheet stacking apparatus which stacks sheets, and more particularly, to a sheet stacking apparatus in which a discharge tray can be folded when a cover of an apparatus body is opened and closed, the discharge tray is extended when the cover is closed and the discharge tray is folded when the cover is opened, and the invention also relates to an image forming apparatus having the sheet stacking apparatus.

2. Description of the Related Art

Conventionally, there is an image forming apparatus which discharges recording sheets of paper (sheets) on which an image is formed in an apparatus body from the apparatus body, and the sheets are stacked on a discharge tray of the apparatus body. Examples of the image forming apparatus are a copying machine, a facsimile machine, a printer and a machine having multifunction of these machines.

As the discharge tray, there is a tray which can be extended if necessary when the recording sheet is of A3 size and long so that the sheet can be stacked and which can handle the long sheet. Such a tray is called an extension tray.

As an extension tray, there is a fixed-type tray which is merely formed into a plate-like shape and is fitted into and fixed to a portion of an exterior of the apparatus body if necessary. There is a turning type tray which is attached to the exterior of the apparatus body by means of a rotation shaft such that the tray can turn, and when the tray is not used, it is in intimate contact with the exterior and when the tray is used, the tray is separated from the exterior and is opened.

As a turning-type extension tray, there is an opening/closing type tray which forms a portion of the exterior and is used also as a cover of the apparatus body and in which the apparatus body is opened and closed. As the opening/closing type tray, there is an extension type tray which can further be pulled out if necessary and extended in a state where the apparatus body is opened (Japanese Patent Application Laid-open No. 2006-188363).

As the extension tray, there is a tray in which a maintenance cover which opens and closes the apparatus body when a cartridge in the apparatus body is to be exchanged or maintenance is to be performed is provided at a location where the cover is turned.

An image forming apparatus of recent years is required to save space for reducing the installation area or an occupying area. In the case of an upper portion of the exterior of the apparatus body is used also as the discharge tray, it is difficult to secure a length of the discharge tray which can stack the long sheet, because of a size limit of the apparatus body.

Generally, in the case of an image forming apparatus having a fixed-type extension tray, since the extension tray projects to a side of the apparatus body, it is necessary to increase a region (occupying region) of space occupied by the image forming apparatus.

In the case of the image forming apparatus having the turning-type extension tray, when the extension tray is opened, the extension tray projects from the side of the apparatus body. Therefore, it is necessary to secure a wide occupied region, and if the occupied region when the extension tray is opened is not taken into account, the extension tray can not be opened.

It is necessary that the image forming apparatus having the extension tray near the maintenance cover is disposed while taking the opening/closing amount of the extension tray, the moving amount of the extension tray and the opening/closing amount of the maintenance cover, and it is necessary to secure a wide occupied region.

It is an object of the present invention to provide a sheet stacking apparatus in which a discharge tray can be folded as a cover of the apparatus body is opened or closed, the discharge tray which can stack the long sheet is capable of installation, and a wide occupied region or a wide installation area is not required, and to provide an image forming apparatus having the sheet stacking apparatus.

SUMMARY OF THE INVENTION

A sheet stacking apparatus comprises: an apparatus body; a cover which is opened and closed with respect to the apparatus body; and a stacking portion on which a discharged sheet is stacked; the stacking portion is provided over the apparatus body and the cover, and the stacking portion can be folded as the cover opens.

According to the sheet stacking apparatus of the invention, the discharge tray is can be folded as a cover of the apparatus body is opened or closed, the discharge tray which can stack the long sheet is capable of installation, a wide installation area are not required, and the space can be saved.

Further features of the present invention will become apparent from the following description of exemplary embodiments (with reference to the attached drawings).

DESCRIPTION OF THE EMBODIMENTS

An image forming apparatus in which a sheet stacking apparatus according to an embodiment of the present invention is integrally incorporated will be explained based on the drawings. The scope of the invention is not limited to materials, shapes and relative disposition of constituent parts of the image forming apparatus of the embodiment unless otherwise specified.

Figure 1:
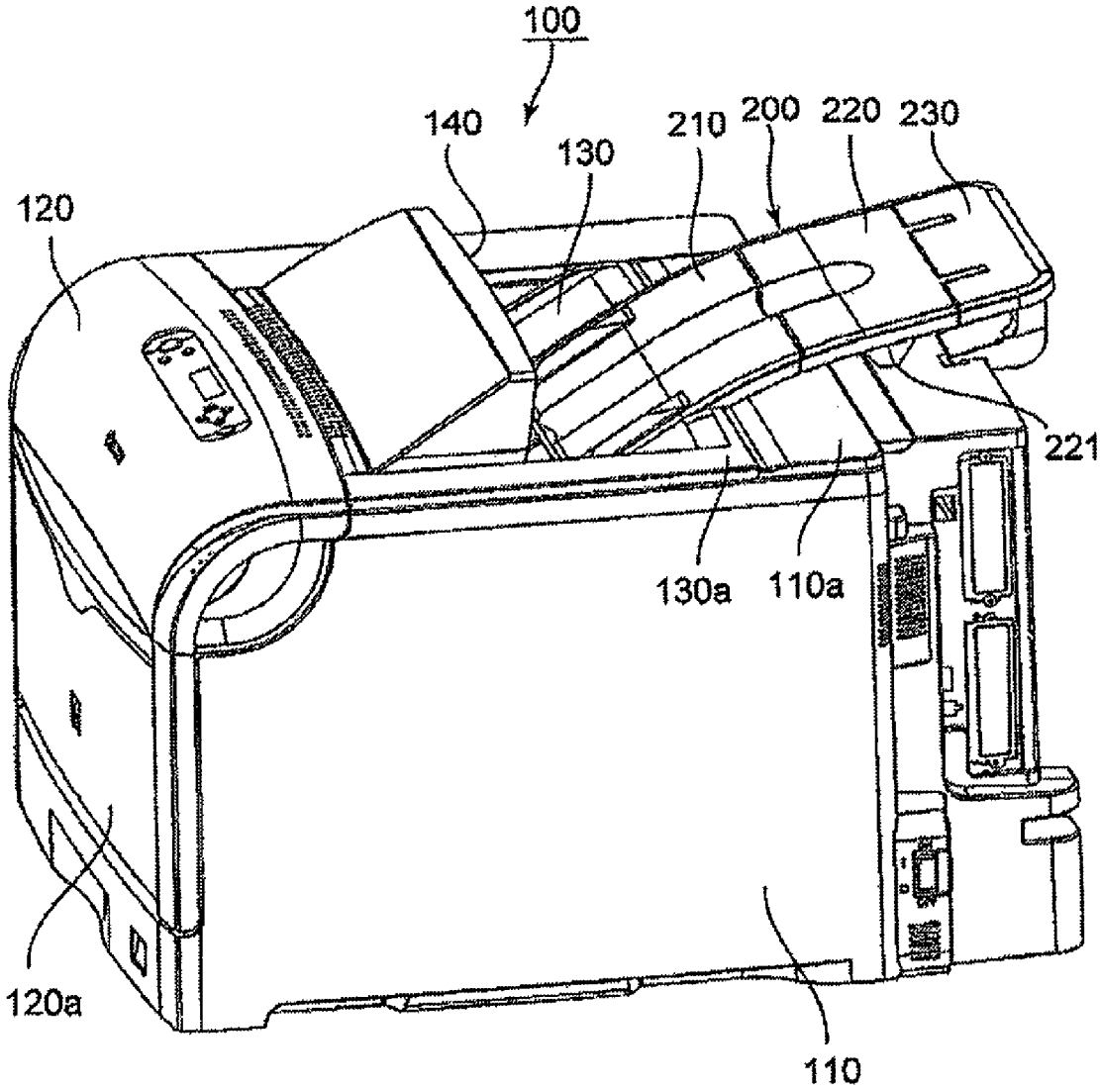
FIG. 1 is a perspective view of an image forming apparatus according to an embodiment of the present invention.
Figure 2:
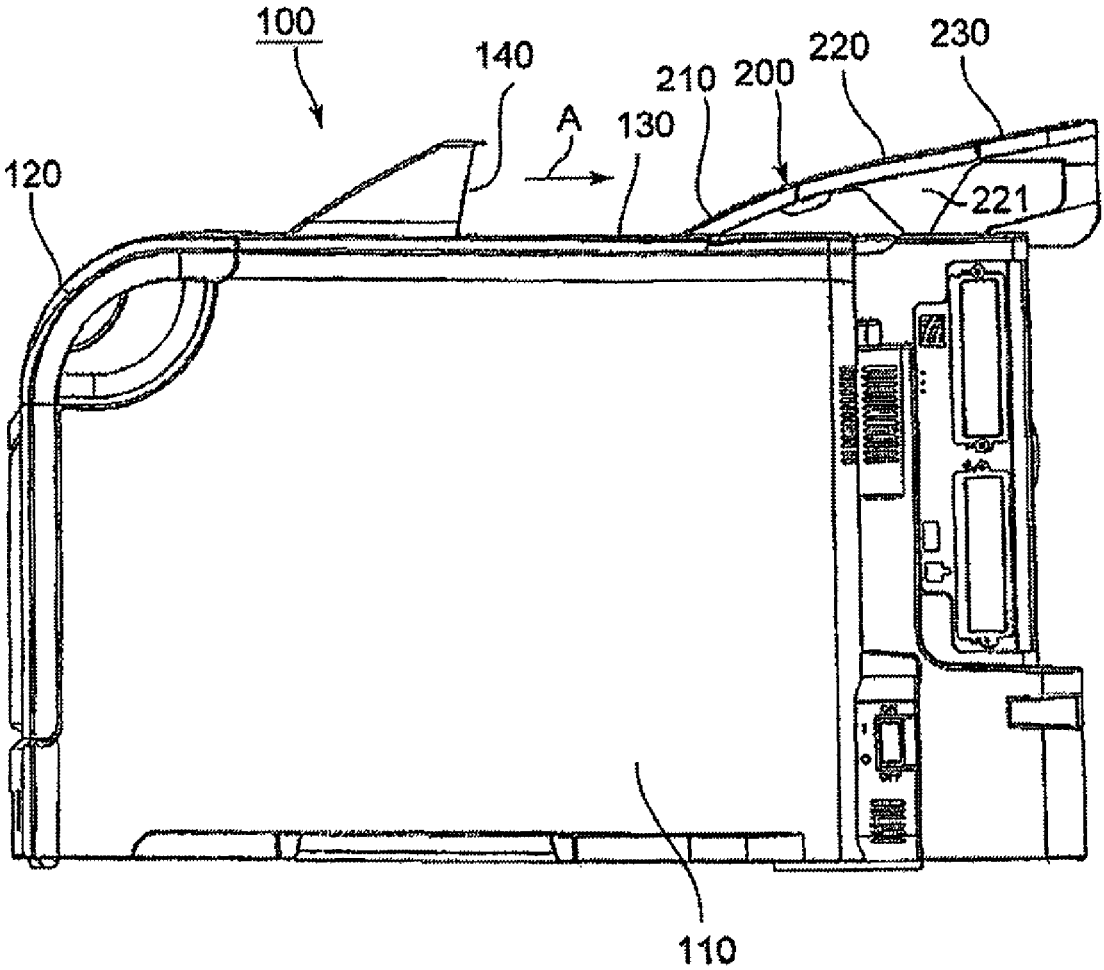
FIG. 2 is a side view of the image forming apparatus shown in FIG. 1.
Figure 3:
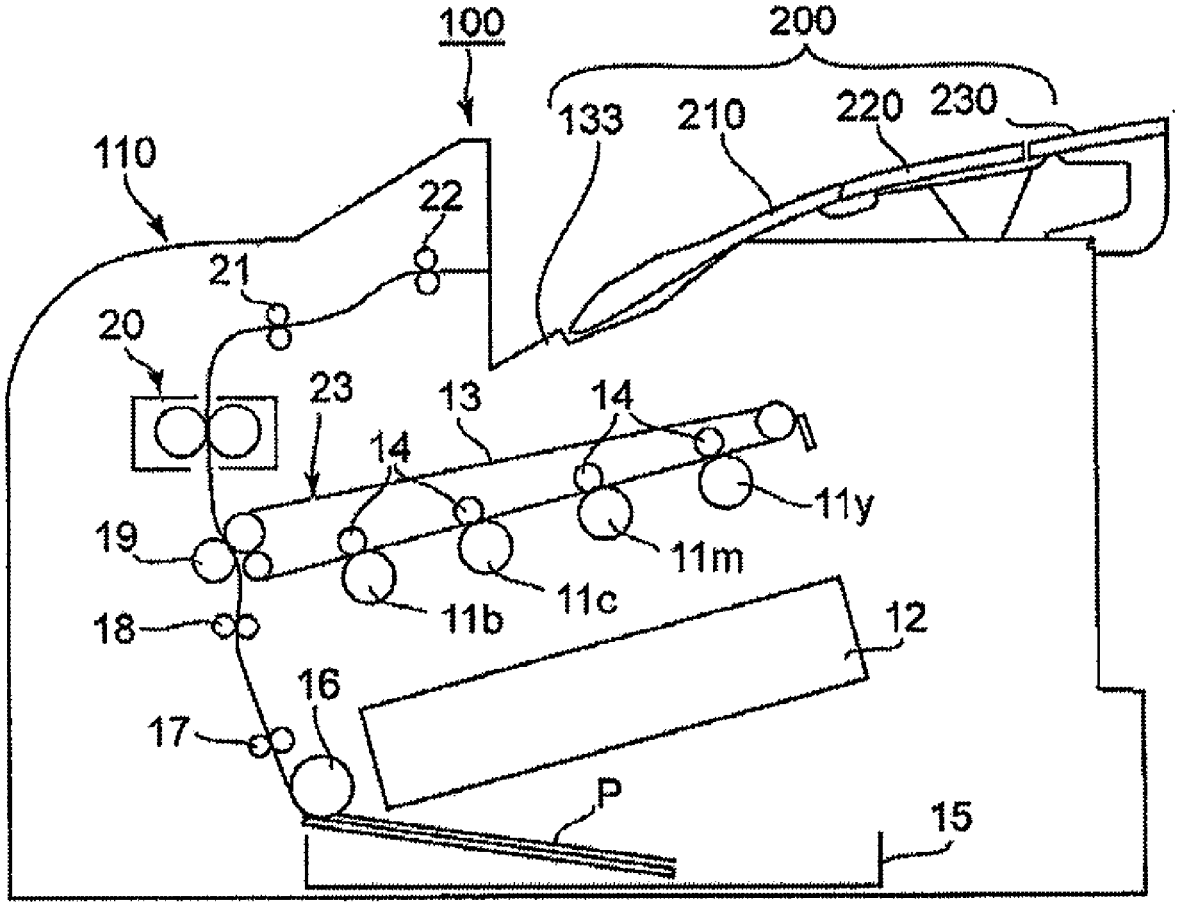
FIG. 3 is a sectional view taken along a transfer direction of a recording paper sheet.
Figure 4:
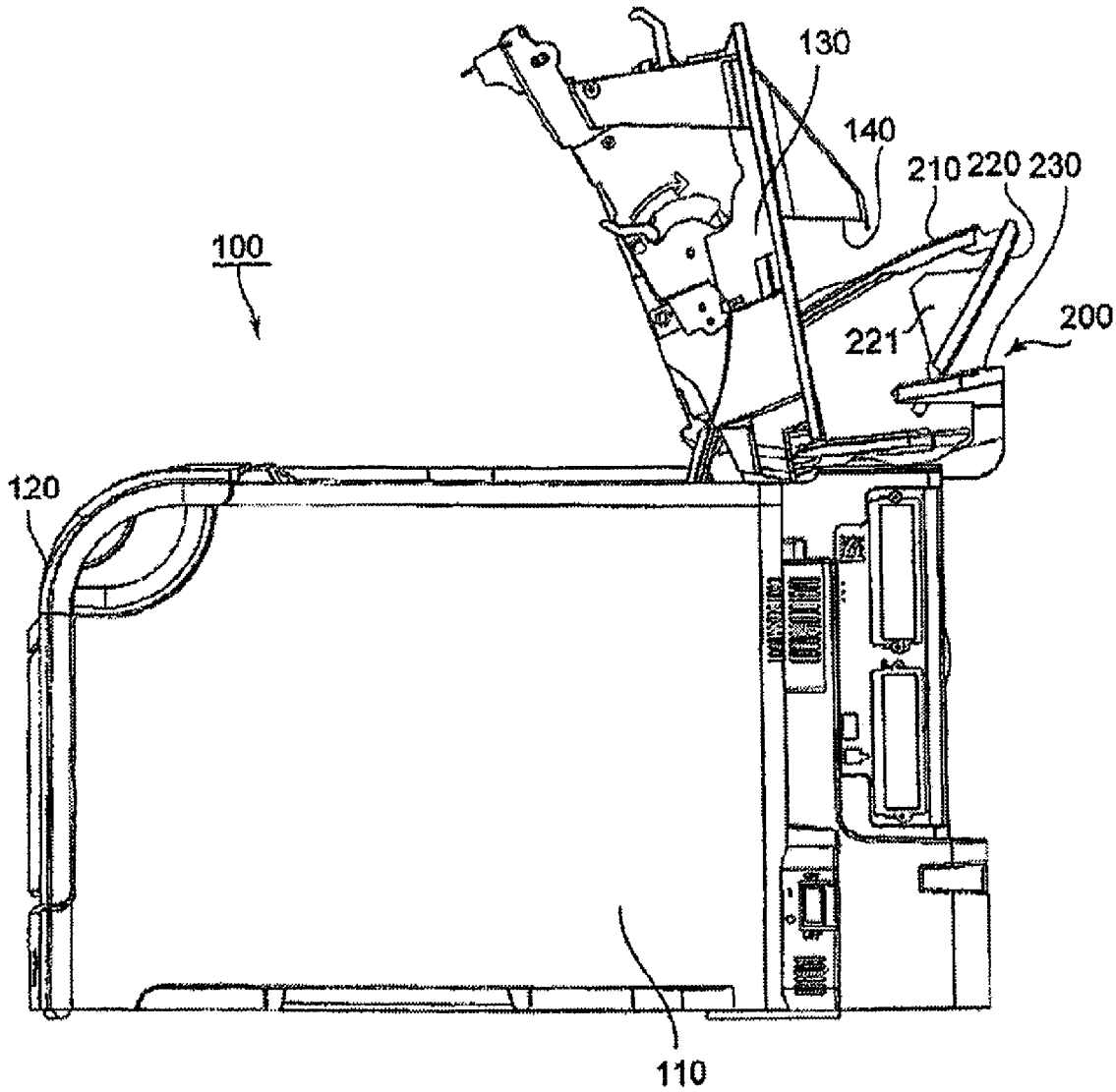
FIG. 4 is a side view of the image forming apparatus when an upper cover is opened and the discharge tray is folded.
Figure 5:
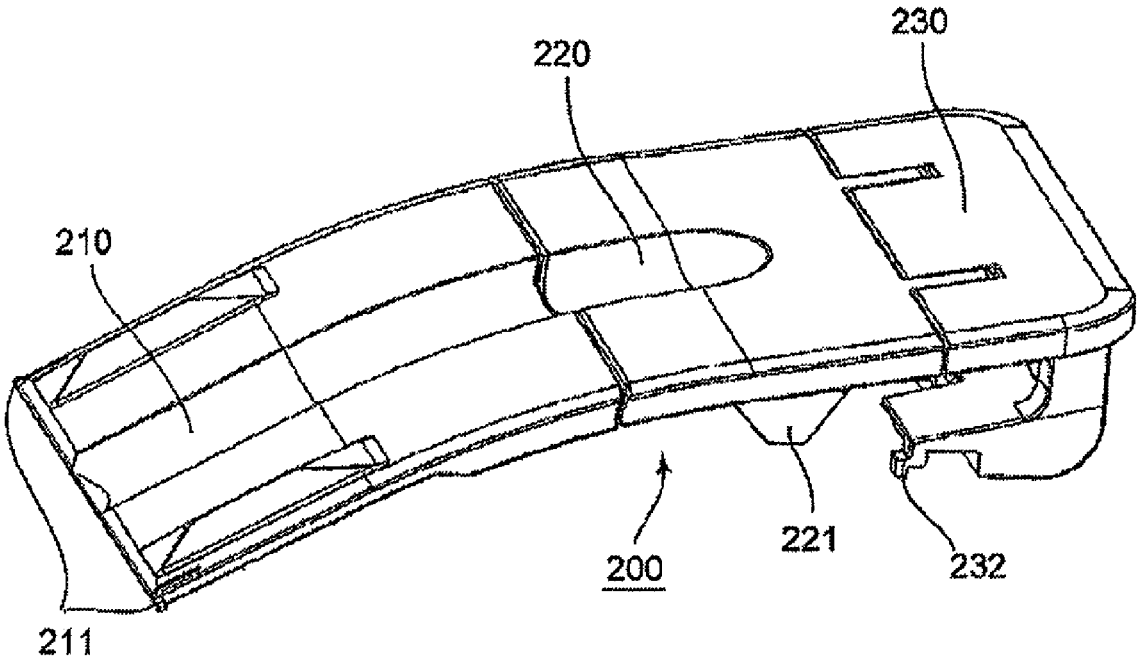
FIG. 5 is a perspective view of the discharge tray in the image forming apparatus shown in FIG. 1.
Figure 6:
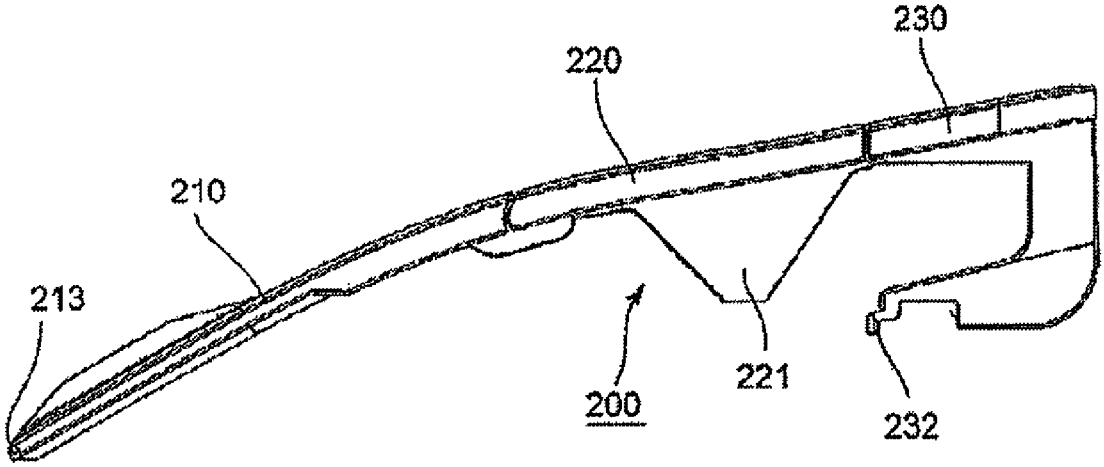
FIG. 6 is a side view of the discharge tray shown in FIG. 5.
Figure 7:
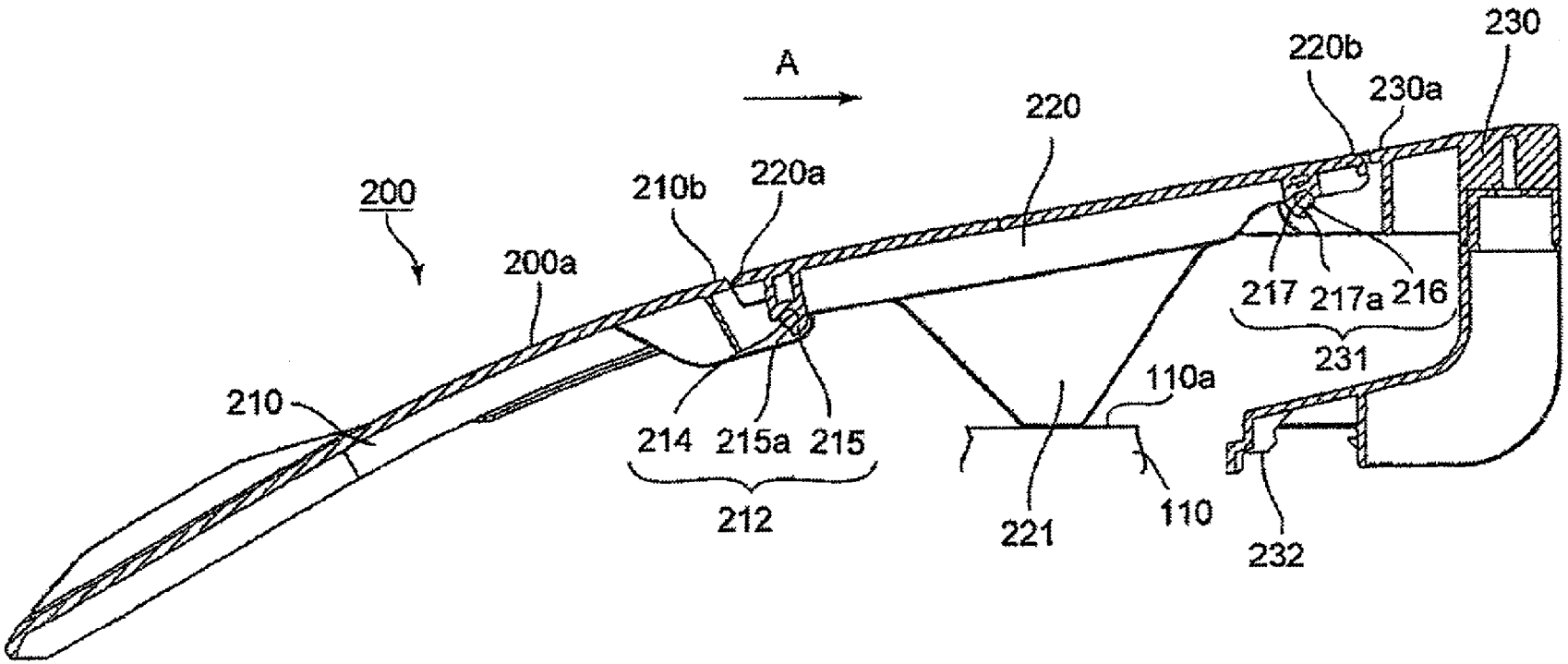
FIG. 7 is a sectional view of the discharge tray shown in FIG. 6 taken along a discharge direction of a recording paper sheet.
Figure 8:
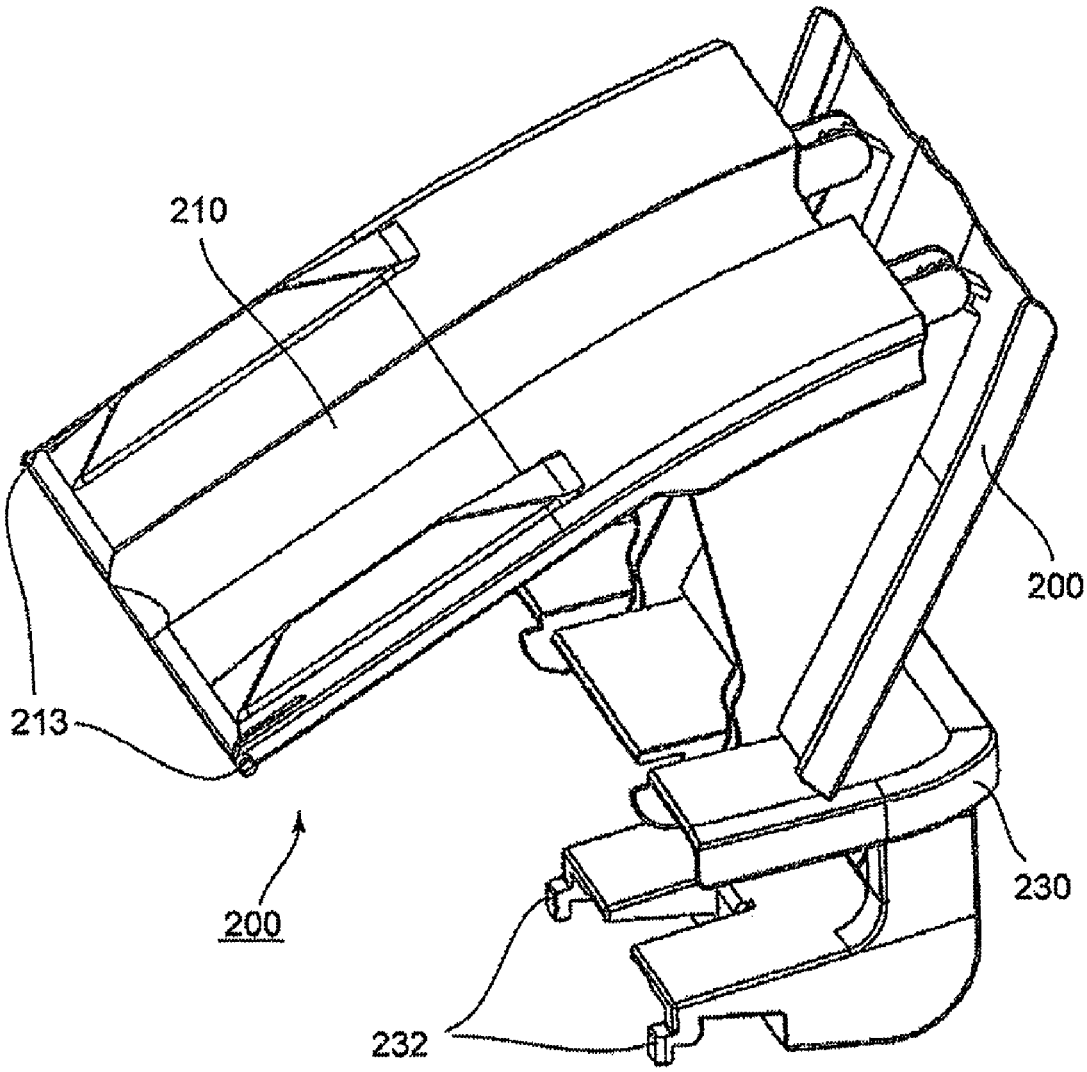
FIG. 8 is a perspective view of the folded discharge tray.
Figure 9:
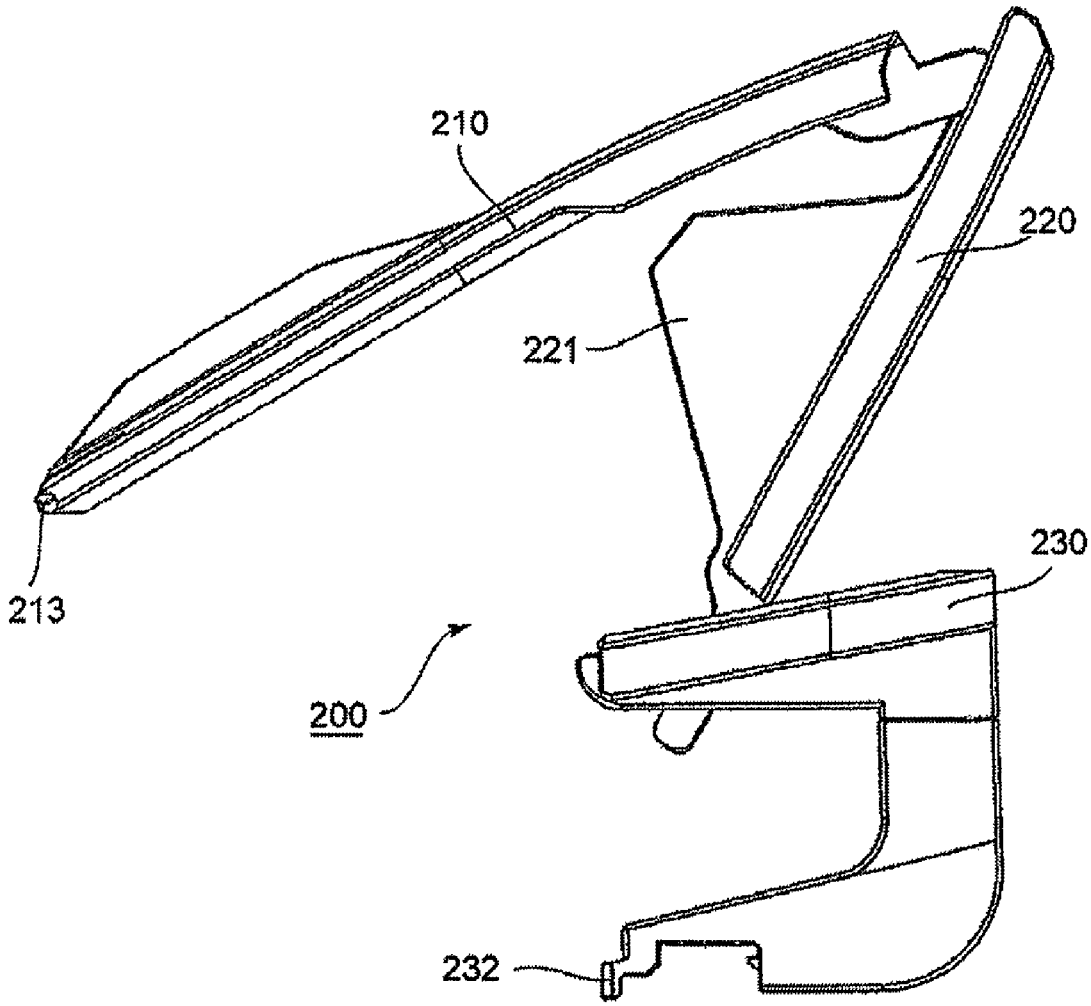
FIG. 9 is a side view of the folded discharge tray.
Figure 10:
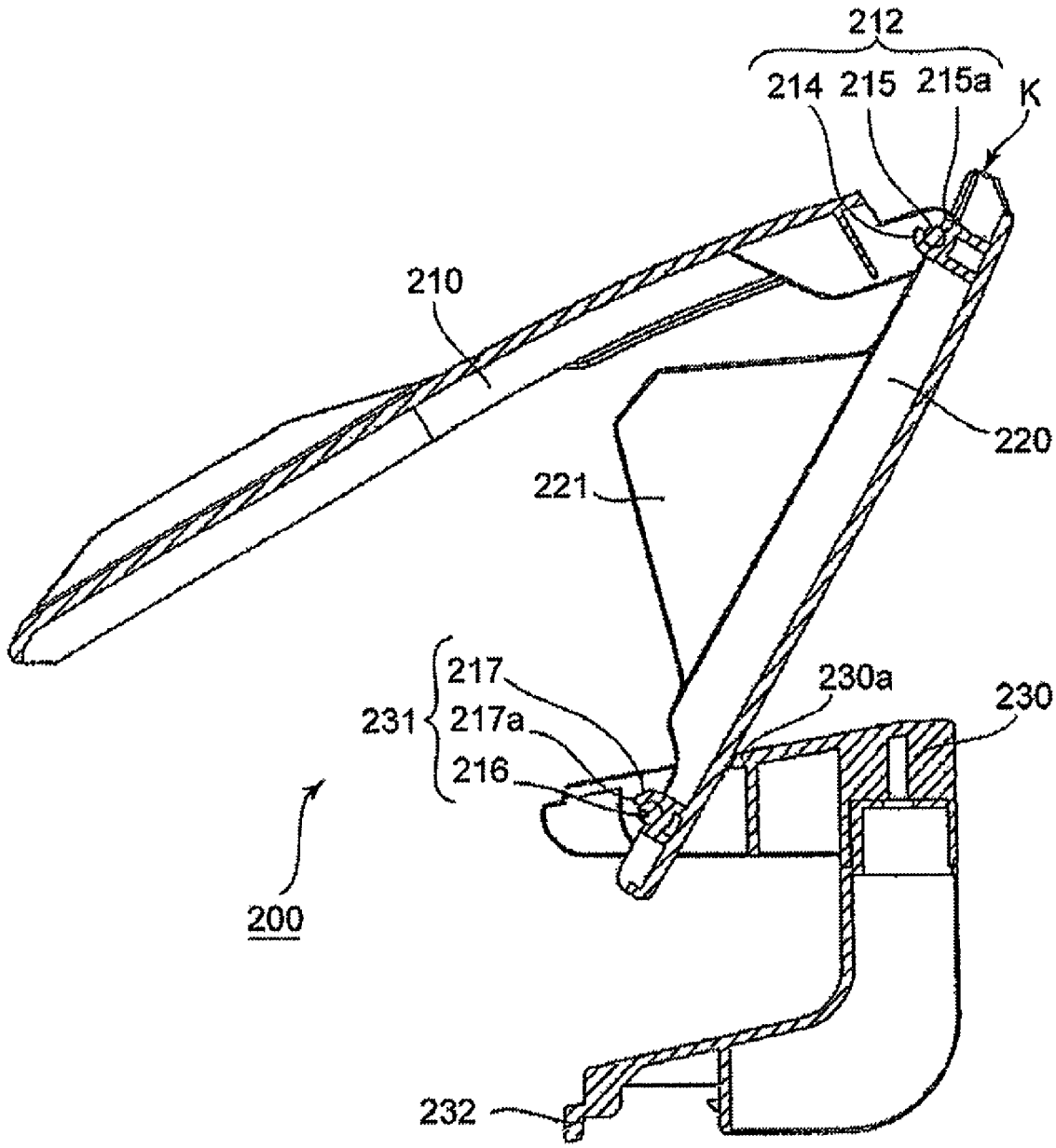
FIG. 10 us a sectional view of the discharge tray shown in FIG. 9 taken along the discharge direction of the recording paper sheet.
Figure 11:
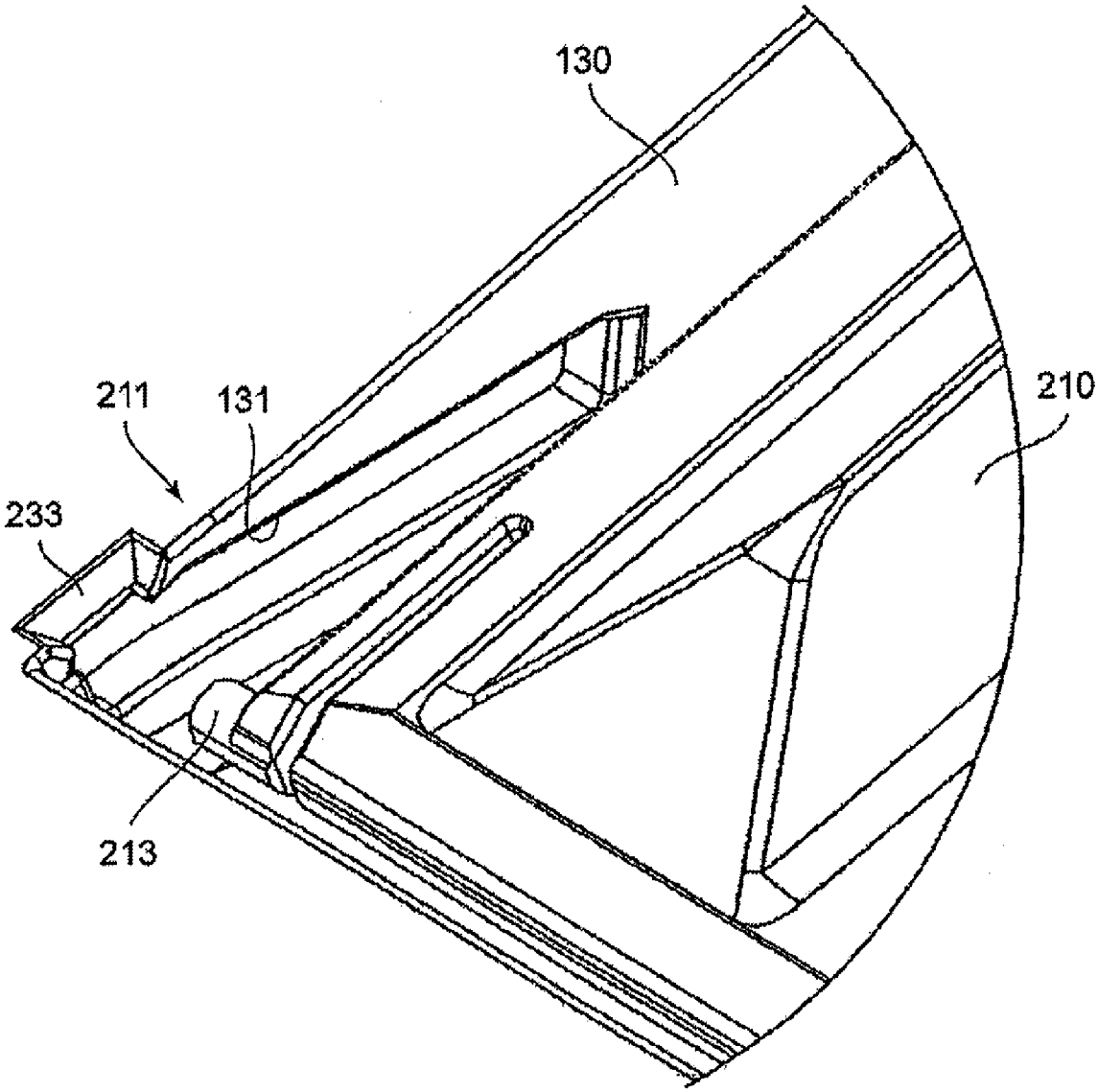
FIG. 11 is an exploded perspective view of peripheries of connection between the upper cover and an upstream tray.
Figure 12:
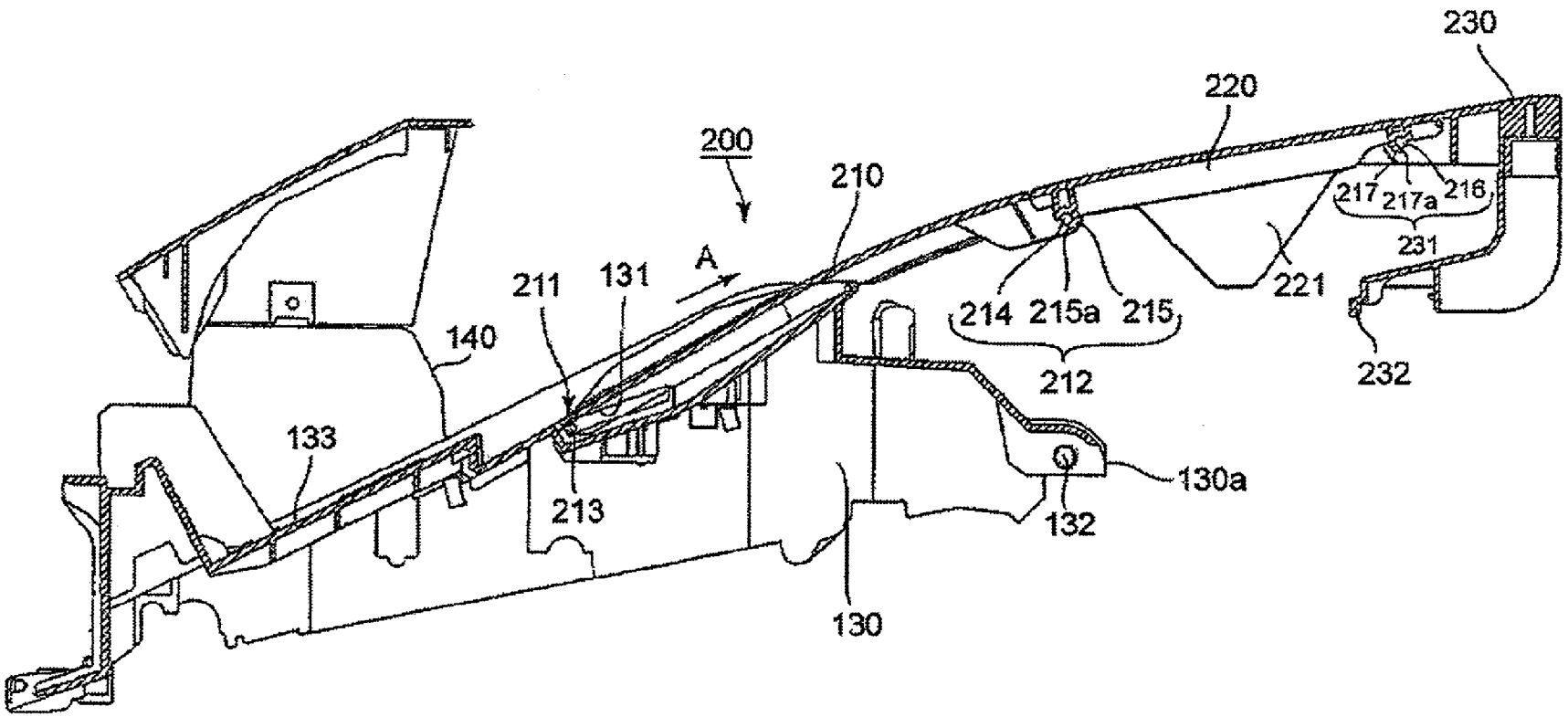
FIG. 12 is a sectional view of the discharge tray taken along the discharge direction of the recording paper sheet when the upper cover is closed.
Figure 13:
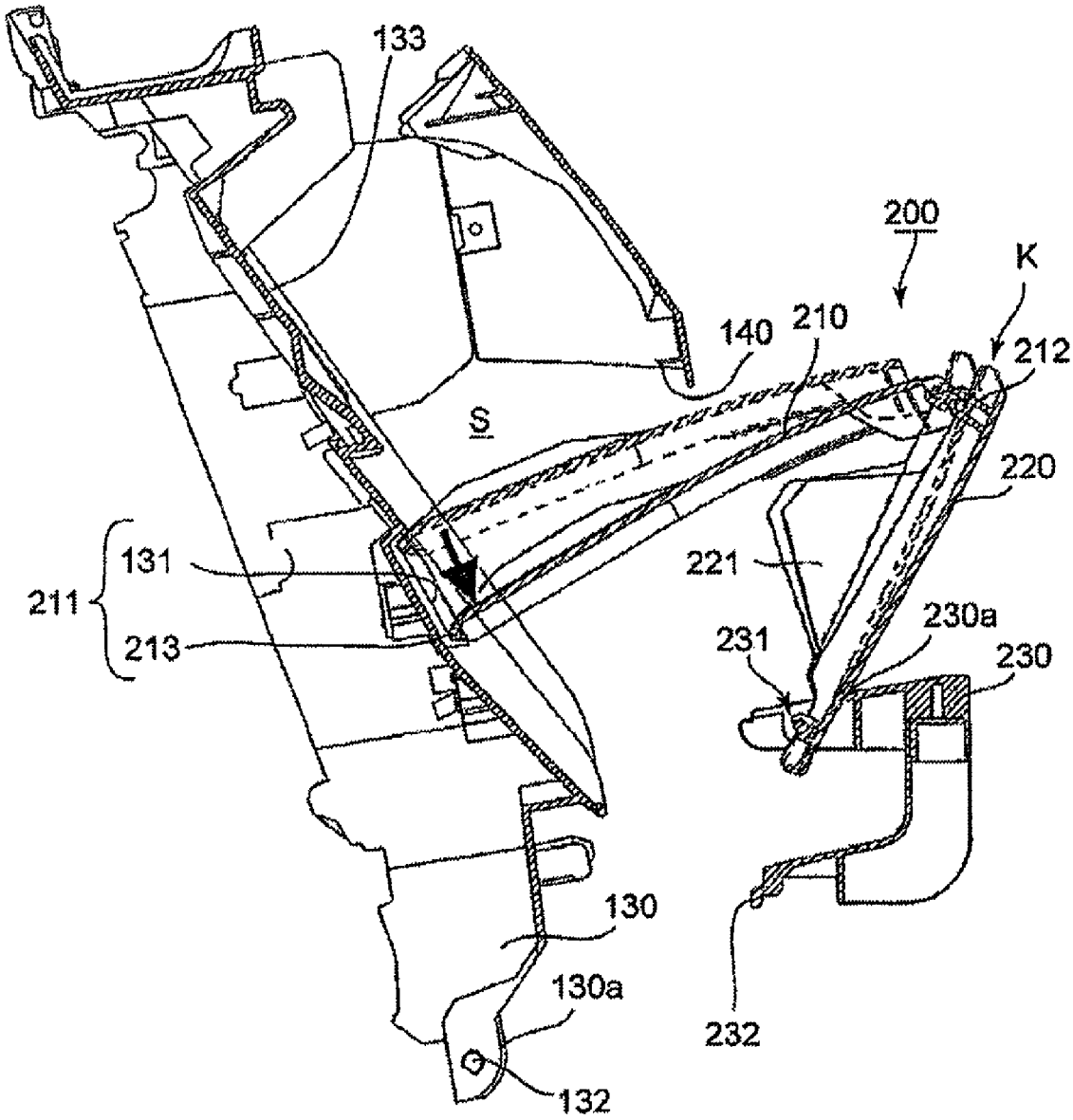
FIG. 13 is a sectional view of the upper cover and the discharge tray when the upper cover is opened taken along the discharge direction of the recording paper sheet.

FIG. 1 is a perspective view of an image forming apparatus according to an embodiment of the present invention. FIG. 2 is a side view of the image forming apparatus 100 shown in FIG. 1. FIG. 3 is a sectional view taken along a transfer direction of a recording paper sheet. FIG. 4 is a side view of the image forming apparatus when an upper cover 130 as a cover is opened and the discharge tray 200 is folded. FIG. 5 is a perspective view of the discharge tray in the image forming apparatus shown in FIG. 1. FIG. 6 is a side view of the discharge tray shown in FIG. 5. FIG. 7 is a sectional view of the discharge tray shown in FIG. 6 taken along a discharge direction of the recording paper sheet (sheet discharge direction). FIG. 8 is a perspective view of the folded discharge tray. FIG. 9 is a side view of the folded discharge tray. FIG. 10 us a sectional view of the discharge tray shown in FIG. 9 taken along the discharge direction of the recording paper sheet. FIG. 11 is an exploded perspective view of peripheries of connection between the upper cover 130 and an upstream tray 210. FIG. 12 is a sectional view of the discharge tray taken along the discharge direction of the recording paper sheet when the upper cover 130 is closed. FIG. 13 is a sectional view of the upper cover and the discharge tray when the upper cover 130 is opened taken along the discharge direction of the recording paper sheet.

The image forming apparatus 100 (FIG. 1) mainly includes an apparatus body 110, a front cover 120, the upper cover 130 and the discharge tray 200.

The apparatus body 110 (FIG. 3) forms a color image on a recording paper sheet (sheet) P therein. Photosensitive drums 11*y*, 11*m*, 11*c* and 11*b* corresponding to yellow, magenta, cyan and black in the apparatus body are irradiated with laser light of a laser scanner 12 based on image information from outside, toner development is carried out, and toner image of each color is formed on outer peripheries thereof. The toner image of each color is sequentially superposed on a circulating transfer belt 13 by a primary transfer roller 14 and is primary transferred.

A recording paper sheet in a sheet cassette 15 is sent out by a sheet feeding roller 16, and the recording paper sheet is pulled out by a pair of pull-out rollers 17. The recording paper sheet is once received by a pair of registration rollers 18, skew feeding is corrected into straight feeding and then, the recording paper sheet is aligned with a toner image on the transfer belt and sent to a nip between a secondary transfer roller 19 and the transfer belt 13.

The secondary transfer roller 19 transfers the toner image on the transfer belt 13 and secondary transfers the toner image on the recording paper sheet. After the toner image is transferred to the recording paper sheet, the sheet is heated by a fixing device 20, the toner image is fixed, the sheet is conveyed by a pair of discharge rollers 21 and 22, discharged into the discharge tray 200 and stacked.

In the above structure, the photosensitive drums 11*y*, 11*m*, 11*c* and 11*b*, the primary transfer roller 14 and the secondary transfer roller 19 constitute an image forming portion 23.

The front cover 120 opens and closes a front portion of the apparatus body 110 around a lower portion 120*a*.

A shaft 132 (FIG. 12) projects from a rear end 130*a* (FIG. 1) of the upper cover 130. The shaft 132 is engaged with a rear end 110*a* of the apparatus body 110 so that the shaft 132 turns upward toward a rear position from a horizontal position of an upper portion of the apparatus body 110 (FIG. 4). Therefore, the upper cover 130 opens and closes with respect to the apparatus body 110 and opens the inside of the apparatus body.

The discharge tray 200 as a stacking portion is divided into four, i.e., the upstream tray 210, an intermediate tray 220, a downstream tray 230 and a sheet stacking portion 133 which is a portion of the stacking portion on the side of the upper cover 130 as division members. The sheet stacking portion 133 of the upper cover 130 is also a portion of the upper cover 130, and is also a portion of the discharge tray 200. The downstream tray 230 is fixed to the apparatus body 110. In this manner, the discharge tray 200 is provided on the apparatus body 110 and the upper cover 130 cross over the shaft 132 as a turning fulcrum of the upper cover 130 to form a link structure. Although the discharge tray 200 is divided into four in the discharge direction of the recording paper sheet in this embodiment, the invention is not limited to this only if the discharge tray 200 is divided into two or more.

The trays (division members) are turnably connected to each other. Thus, the discharge tray 200 can be folded as the upper cover 130 opens, and can be extended as the upper cover 130 closes.

An upstream end of the upstream tray 210 in the discharge direction of the recording paper sheet (direction of the arrow A) is turnably connected to the upper cover 130 by an upstream connection 211 (FIGS. 11 and 12), and a downstream end of the upstream tray 210 is turnably connected to an intermediate tray 220 by an intermediate connection 212 (FIG. 7).

As shown in FIGS. 3 and 11 to 13, the sheet stacking portion 133 is also a portion of the upper cover 130 and a portion of the discharge tray 200. An upstream connection 211 is disposed downstream of the sheet stacking portion 133. The upstream connection 211 (FIGS. 11 and 12) has a columnar shaft 213 projecting from both sides on the upstream side along the discharge direction of the recording paper sheet of the upstream tray 210. The shaft 213 is movably engaged with a long groove 131 as a guide portion formed on the upper cover 130 along the discharge direction of the recording paper sheet. The shaft 213 is inserted into the long groove 131 from a receiving portion 233 formed in one end of the long groove 131. The shaft 213 may project from the upper cover 130, and the long groove 131 may be formed in the upstream tray 210. Although the guide portion of the embodiment has a bottom to enhance its outward appearance and strength, the guide portion may be a through hole.

The intermediate connection 212 (FIG. 7) has such a structure that semi-circular shaft receivers 215 provided on both sides of the upstream side of the intermediate tray 220 along the discharge direction of the recording paper sheet are engaged with columnar projections 214 provided on both sides of the downstream side of the upstream tray 210 along the discharge direction of the recording paper sheet. The shaft receivers 215 have resiliency, and when the shaft receivers 215 receive the projections 214, the opening 215*a* once opens and then returns to the original position. The projections 214 may project from the intermediate tray 220 and the shaft receivers 215 may be formed in the upstream tray 210.

An upstream end of the intermediate tray 220 (FIG. 7) in the discharge direction of the recording paper sheet is rotatably connected to the upstream tray 210 by the intermediate connection 212, and a downstream end of the intermediate tray 220 is rotatably connected to the downstream tray 230 by the downstream connection 231.

The downstream connection 231 (FIG. 7) has such a structure that semi-circular shaft receivers 217 provided on both sides of a downstream side of the intermediate tray 220 along the discharge direction of the recording paper sheet are engaged with columnar projections 216 projecting from both sides of an upstream side of the downstream tray 230 along the discharge direction of the recording paper sheet. The shaft receivers 217 have resiliency, and when the shaft receivers 217 receive the projections 216, the opening 217*a* once opens and then returns to the original position. The projections 216 may project from the intermediate tray 220 and the shaft receivers 217 may be formed in the downstream tray 230.

The downstream tray 230 is fixed to the apparatus body 110 by a fixing pawl 232.

In this structure, the intermediate connection 212 (FIG. 7) and the downstream connection 231 are provided on the side of a lower surface of the discharge tray 200 so that recording paper sheets can be stacked on a recording paper sheet stacking surface 200*a*.

The shaft receivers 215 and 217 of the intermediate connection 212 (FIG. 7) and the downstream connection 231 are provided on both ends of the intermediate tray 220 such that the openings 215*a* and 217*a* are directed downward. Therefore, when the discharge tray 200 is assembled, the intermediate tray 220 is pushed into the projections 214 and 216 from above, and the shaft receivers 215 and 217 can easily be attached, and the assembling operation can be carried out easily.

The upstream connection 211 (FIGS. 11 and 12) includes the long groove 131 and the shaft 213. Thus, the shaft 213 of the discharge tray 200 is moved downstream in the discharge direction of the recording paper sheet in the long groove 131 by its own weight, the discharge tray 200 is bent at the intermediate connection 212 and the downstream connection 231, the discharge tray 200 is formed into such a shape that the entire discharge tray 200 drops into a U-shape, and there is a concern that it may be difficult to stack the recording paper sheets. Hence, a support rib 221 which abuts against the rear end 110*a* of the apparatus body 110 to prevent the same from brought into a drop shape projects from a lower surface of the intermediate tray 220 (FIG. 1). The downstream end 210*b* (FIG. 7) of the upstream tray and the upstream end 220*a* of the intermediate tray may abut against each other, the downstream end 220*b* of the intermediate tray and the upstream receiver 230*a* of the downstream tray 230 may abut against each other to prevent the drop shape instead of providing the support rib.

In the above structure, if the upper cover 130 (FIGS. 11 and 12) is opened around the shaft 132, a distance between the upstream connection 211 and the downstream connection 231 is reduced. Thus, the upstream tray 210 and the intermediate tray 220 follow the upper cover 130 and rotate and are bent. The upstream tray 210 moves as the upper cover 130 opens by the relative movement between the shaft 213 of the upstream connection 211 and the long groove 131 of the upper cover 130 and the upstream tray 210 turns. At that time, the upstream tray 210 turns around the intermediate connection 212 and moves. The intermediate tray 220 turns around the downstream connection 231 in the same direction as the opening direction of the upper cover 130. Since the downstream tray 230 is fixed to the apparatus body 110, the downstream tray 230 does not move irrespective of opening and closing motion of the upper cover 130.

In the above structure, the positional relation of the various elements of the discharge tray 200 when the upper cover 130 is opened is as follows:

First, the upstream connection 211 as a first connection which connects the upstream tray 210 to the upper cover 130 is set lower than the intermediate connection 212 as a second connection which connects the intermediate tray 220 as the other division member to the upstream tray 210.

It is preferable that the upper cover 130 is opened or closed after recording paper sheets on the discharge tray 200 are removed. However, if the above-described positional relation is established when a user erroneously opens the upper cover 130 while recording paper sheets are stacked on the discharge tray 200, it is possible to prevent the recording paper sheet on the discharge tray from falling.

When the upstream tray moves as the upper cover 130 is opened and the upstream tray turns as shown in FIGS. 11 and 12, if a wide space S between a discharge opening 140 and the upstream tray 210 is secured, it is possible to prevent the recording paper sheet from being sandwiched between the discharge opening 140 and the upstream tray 210.

Second, a bent portion K formed by the intermediate connection 212 is set such that it is accommodated within a surface of projection when the upper cover 130 sees the apparatus located in the open position from the ceiling. That is, this structure prevents the bent portion K from projecting outward of the installation region of the image forming apparatus.

This can be set by the relation of lengths of various members. Alternatively, as shown in FIG. 13, the intermediate tray 220 may be received by an upstream receiver 230*a* of the downstream tray 230 to limit the turning motion so that the bent portion K is accommodated within the surface of projection. In this case, the upstream receiver 230*a* is a restriction member.

The image forming apparatus is extended when the discharge tray 200 closes the upper cover 130, and the image forming apparatus is folded when the upper cover is opened. Thus, the occupied region of the entire apparatus when the upper cover is open and thus, the installation area need not be wide, and the space can be saved.

The discharge tray 200 does not protrude (project) from the installation region of the image forming apparatus 100 irrespective of opening and closing motion of the upper cover 130, the occupied region of the image forming apparatus and thus, the installation area need not be wide, and the space can be saved.

Figure 14:
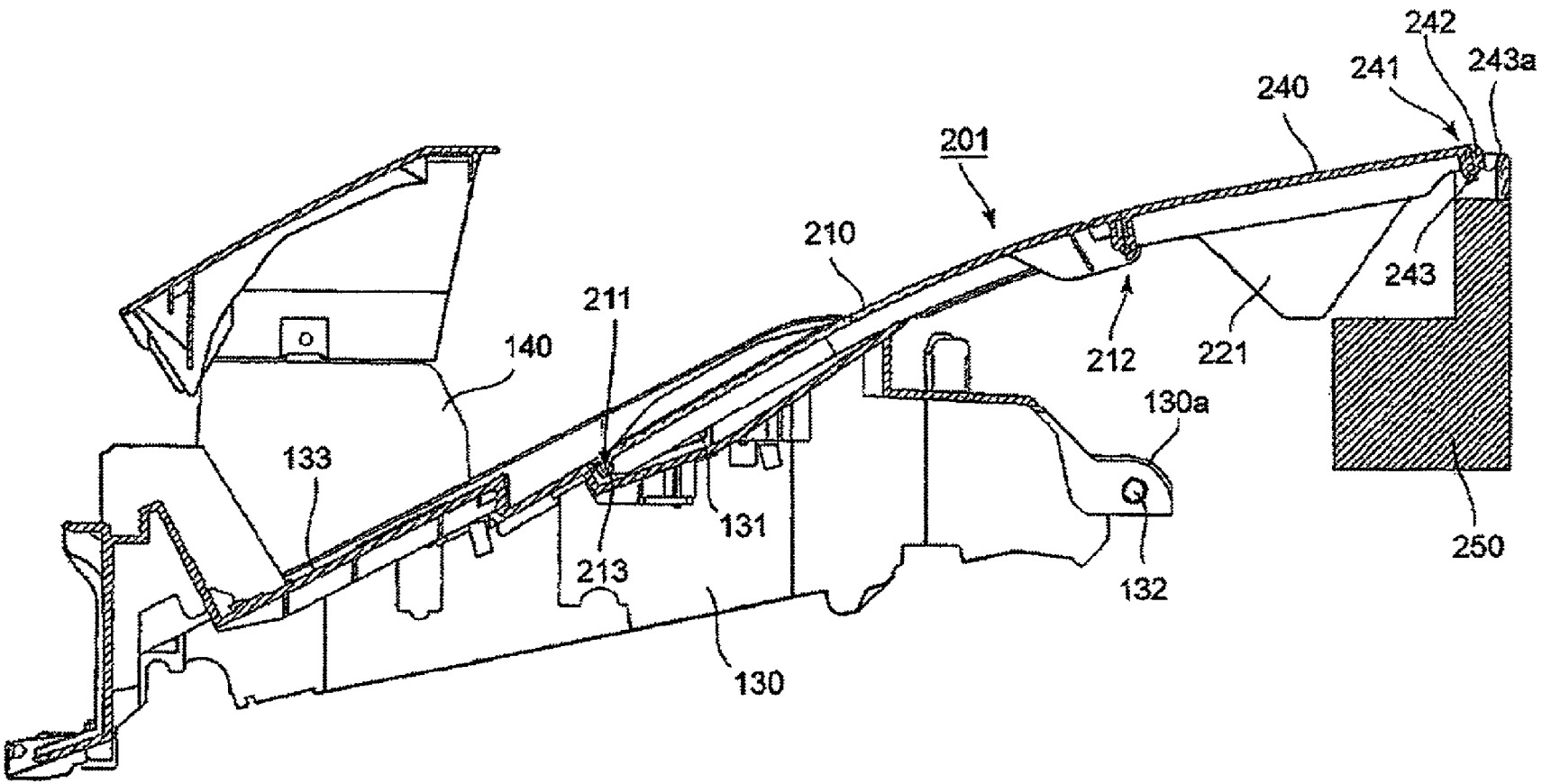
FIG. 14 is a diagram of another discharge tray corresponding to FIG. 12.
Figure 15:
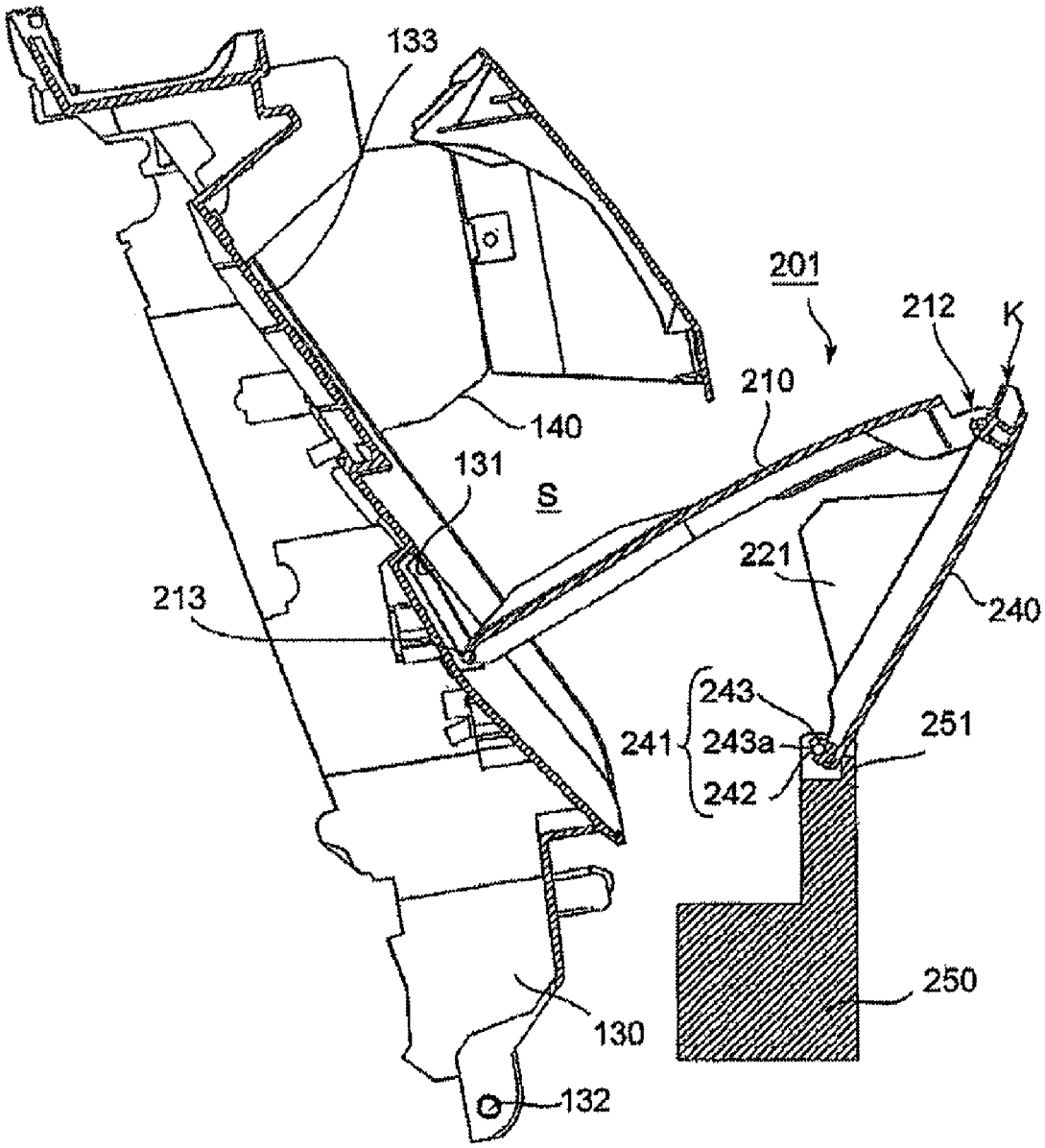
FIG. 15 is a sectional view of the discharge tray shown in FIG. 14 when the upper cover is opened and the discharge tray is folded taken along the discharge direction of the recording paper sheet, and FIG. 15 corresponds to FIG. 13.

Although the discharge tray 200 is folded into four, a portion of the stacking portion provided in the apparatus body may be omitted like the discharge tray 201 shown in FIGS. 14 and 15, and the discharge tray 200 may be folded into three.

That is, in the case of the discharge tray 201 shown in FIGS. 14 and 15, the downstream tray 230 of the discharge tray 200 is omitted, the intermediate tray 220 is rotatably provided on a portion 250 of the apparatus body as the discharge tray by the downstream connection 241. Although the discharge tray in FIGS. 14 and 15 is the same as the intermediate tray 220 in FIGS. 1 to 13, the discharge tray in FIGS. 14 and 15 is designated with a symbol 240.

The downstream connection 241 has such a structure that semi-circular shaft receivers 243 provided on both sides of a downstream side of the discharge tray 240 as the division member in the discharge direction of the recording paper sheet are engaged with columnar projections 242 projecting from both sides of the portion 250 of the apparatus body. The shaft receivers 243 have resiliency, and when the shaft receivers 243 receive the projections 242, the opening 243*a* once opens and then returns to the original position. The projections 242 may project from the discharge tray 240 and the shaft receivers 243 may be formed on the portion 250 of the apparatus body.

The image forming apparatus having the discharge tray 201 also exhibit the same effect as the image forming apparatus having the discharge tray 200.

The positional relation of the various members of the discharge tray 201 as the stacking portion when the upper cover 130 is opened is as follows:

First, the upstream connection 211 as the first connection which connects the upstream tray 210 to the upper cover 130 is set lower than the intermediate connection 212 as the second connection which connects the discharge tray 240 as the other division member to the upstream tray 210.

With this, even when a user erroneously opens the upper cover 130 while recording paper sheets are stacked on the discharge tray 201, and it is possible to prevent the recording paper sheet on the discharge tray from falling.

Since the wide space S between the discharge opening 140 and the upstream tray 210 is secured, it is possible to prevent the recording paper sheet from being sandwiched between the discharge opening 140 and the upstream tray 210.

Second, the bent portion K formed by the intermediate connection 212 is set such that it is accommodated within a surface of projection when the upper cover 130 sees the image forming apparatus located in the open position from the above. That is, this structure prevents the bent portion K from projecting outward of the installation region of the image forming apparatus.

This can be set by the length relation of the various members, but as shown in FIG. 15, the discharge tray 240 may be received by a receiver piece 251 which projects from a portion of the apparatus body, turning motion is limited and the bent portion K may be accommodated within the surface of projection. In this case, the receiver piece 251 is a restriction member.

With this, the discharge tray 201 does not protrude (project) from the installation region of the image forming apparatus 100 irrespective of opening and closing motion of the upper cover 130, the occupied region of the image forming apparatus and thus, the installation area need not be wide, and the space can be saved.

The two discharge trays 200 and 201 have the common structures in that the upstream tray 210 as the division member is connected to the upper cover 130 having the sheet stacking portion 133 as the division member constituting a portion of the discharge tray. The downstream tray 230 of the discharge tray 200 among the downstream trays 230 and 240 as the division members connected to the apparatus body 110 is integrally formed on the apparatus body 110, and the discharge tray 240 of the discharge tray 201 is turnably connected to the apparatus body 110. The upstream ends of the two discharge trays 200 and 201 are integrally formed on the upper cover 130, and the downstream ends thereof are integrally or turnably provided on the apparatus body, and are provided over the upper cover 130 and the apparatus body.

Although the image forming apparatus in which the sheet stacking apparatus is integrally incorporated in the apparatus body is explained in the embodiment, the present invention is also effective even if the sheet stacking apparatus is connected to the image forming apparatus as a separate apparatus such as a finisher which processes a sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-137841, filed May 24, 2007, No. 2008-128238 filed May 15, 2008 which are hereby incorporated by reference herein in their entirety.

What is claimed is:

1. A sheet stacking apparatus comprising:

an apparatus body;

discharge rollers to discharge a sheet from the apparatus body;

a cover which is opened and closed with respect to the apparatus body; and a stacking portion on which the sheet discharged from the apparatus body by the discharge rollers is stacked, wherein the stacking portion is divided into a plurality of division members sequentially connected in a direction in which the sheet is discharged, with the first of the plurality of division members being also immediately connected to the cover, and the last of the plurality of division members being also immediately connected to the apparatus body, and each of the plurality of division members can rotate around where it is connected to another of the plurality of division members, the cover, or the apparatus body.

2. The sheet stacking apparatus according to claim 1, wherein the stacking portion is located above and spanning across a turning fulcrum of the cover with respect to the apparatus body.

3. The sheet stacking apparatus according to claim 1, further comprising a connection which connects one of the plurality of division members to the cover and includes a guide portion extending along the discharge direction of the sheet and a shaft, which can be engaged with the guide and moved.

4. The sheet stacking apparatus according to claim 1, further comprising a restriction member which restricts turning motion of the division members when the stacking portion is folded, thereby to prevent the stacking portion from projecting outward of an installation region of the apparatus body.

5. An image forming apparatus comprising:

an apparatus body having an image forming portion which forms an image on a sheet;

discharge rollers to discharge a sheet from the apparatus body;

a cover which is opened and closed with respect to the apparatus body; and a stacking portion on which the sheet discharged from the apparatus body by the discharge rollers is stacked, wherein the stacking portion is divided into a plurality of division members sequentially connected in a direction in which the sheet is discharged, with the first of the plurality of the division members being also immediately connected to the cover, and the last of the plurality of the division members being also immediately connected to the apparatus body, and each of the plurality of division members can rotate around where it is connected to another of the plurality of division members, the cover, or the apparatus body.

6. The image forming apparatus according to claim 5, wherein the stacking portion is located above and spanning across a turning fulcrum of the cover with respect to the apparatus body.

7. The image forming apparatus according to claim 5, further comprising a connection which connects one of the plurality of division members to the cover and includes a guide portion extending along the discharge direction of the sheet and a shaft, which can be engaged with the guide and moved.

8. The image forming apparatus according to claim 5, further comprising a restriction member which restricts turning motion of the division members when the stacking portion is folded, thereby to prevent the stacking portion from projecting outward of an installation region of the apparatus body.

* * * * *